US005117207A

United States Patent [19]

Powell et al.

[11] Patent Number: 5,117,207

[45] Date of Patent: May 26, 1992

[54] MONOLITHIC MICROWAVE AIRBRIDGE

[75] Inventors: Scott D. Powell, Londonderry, N.H.; David E. Meharry, Lexington, Mass.

[73] Assignee: Lockheed Sanders, Inc., Nashua, N.H.

[21] Appl. No.: 559,473

[22] Filed: Jul. 30, 1990

[51] Int. Cl.[5] ..... H01F 3/08

[52] U.S. Cl. ..... 333/1; 333/104

[58] Field of Search ..... 333/101, 1, 103, 104, 333/262, 124; 379/292; 340/825.89, 825.9, 825.91; 307/571

[56] References Cited

U.S. PATENT DOCUMENTS

| | | | |
|---|---|---|---|
| 3,104,363 | 9/1963 | Butler | 333/246 |
| 3,250,860 | 5/1966 | Vincent et al. | 333/101 X |
| 3,354,435 | 11/1967 | Picciano | 340/825.9 |
| 3,470,499 | 9/1969 | Lentz | 333/101 |
| 3,786,425 | 1/1974 | Hetherington et al. | 340/825.89 |
| 3,833,866 | 9/1974 | Boutelant | 333/103 X |
| 4,533,883 | 8/3985 | Hudspeth et al. | 333/1 |
| 4,675,620 | 6/1987 | Fullerton | 333/1 |
| 4,731,594 | 3/1988 | Kumar | 333/103 |
| 4,983,865 | 1/1991 | Ho et al. | 307/571 |

FOREIGN PATENT DOCUMENTS

| | | | |
|---|---|---|---|
| 179703 | 9/1985 | Japan | 333/1 |
| 197101 | 8/1988 | Japan | 333/262 |

*Primary Examiner*—Eugene R. LaRoche
*Assistant Examiner*—Benny Lee
*Attorney, Agent, or Firm*—David W. Gomes

[57] ABSTRACT

A monolithic microwave switch matrix includes fully monolithic construction for crossovers as well as switches and input transmission lines configured as lumped equivalent transmission lines for reduced power loss. The crossovers include a grounded conductor located between the crossing transmission lines.

1 Claim, 4 Drawing Sheets

MONOLITHIC MICROWAVE AIRBRIDGE

BACKGROUND OF THE INVENTION

1. Field of the Invention

The present invention generally relates to monolithic microwave switch matrices and, in particular, to such matrices which may be cascaded to form a larger matrix.

2. Statement of the Prior Art

Switch matrices are commonly used in complex communication equipment wherever great flexibility is required in the coupling of any number of signals to any number of terminals. The most desirable switch matrix is typically a full access matrix in which any one or more of a multiplicity of input terminals of the matrix can be simultaneously connected to any one or more, or different combinations of, a multiplicity of output terminals thereof. When the frequencies of the signals handled by such matrices reach into the gigahertz range and above, many problems are encountered in the distribution of the received input power. One approach at solving these various problems is described in U.S. Pat. No. 4,731,594 for a "Planar Active Component Microwave Switch Matrix and Airbridge for Use Therewith" and its related U.S. Pat. Nos. 4,611,814 and 4,609,889 for a "Microwave Frequency Power Divider" and a "Microwave Frequency Power Combiner", respectively. This approach uses field effect transistors, FETS, as amplifiers for dividing power from the input lines and also for combining power into the output lines to enable full access switching and to prevent power loss which would prohibit the construction of large switch matrices.

Similar power distribution problems have also been addressed in the area of distributed amplifiers as evidenced in the article "High Yield, 0.4 W, 2-18 GHz GaAs Distributed Amplifiers" by W. Cooper, et al., Coolied Microwave, May 1989, pages 98-106. The article describes distributed amplifiers comprised of a multiplicity of FETs which receive input signals parallel from a transmission line. The effect of the gatesource capacitance of the FETs on the transmission line is countered by inductance built into the line creating a lumped equivalent transmission line.

Important considerations in the construction of switch matrices are full access switching, the designing of cascadeable modules to allow easy tailoring of a matrix to a variety of systems without extra expense, the power distribution of very high frequency signals over a potentially large number of matrix switch points, the construction of crossovers between input and output transmission lines providing isolation therebetween and consistent transmission characteristics among crossovers, and the usual size, cost and power requirements.

SUMMARY OF THE INVENTION

Accordingly, the present invention provides a microwave switch matrix which maintains high performance characteristics in high frequency broadband applications. The switch matrix includes a substrate, a first plurality of conductors disposed on one side of the substrate, a second plurality of conductors disposed on one side of the substrate with each of the conductors of the second plurality intersecting with each of the conductors of the first plurality, a separate crossover means located at each intersection between conductors of the first and second pluralities for preventing direct electrical contact therebetween with each crossover including an airbridge, a separate switch means located in proximity to each intersection for providing switchable electrical connection between each conductor of the first plurality and each conductor of the second plurality with each switch means including an input terminal connected to a conductor of the first plurality and appearing electrically to that conductor as a net capacitive reactance, and separate inductor means serially connected in the conductors of the first plurality and to each input terminal for reactively balancing the capacitive reactance of the input terminal.

A crossover associated with the present invention includes a substrate, a lower conductor formed on a surface of the substrate, a spacer formed on top of the lower conductor, a grounded conductor formed on top of the spacer, and an upper conductor formed as an airbridge over and separated from the grounded conductor.

BRIEF DESCRIPTION OF THE DRAWINGS

The present invention is illustratively described with respect to the appended drawings in which.

DETAILED DESCRIPTION OF THE DRAWINGS

Figure 1:
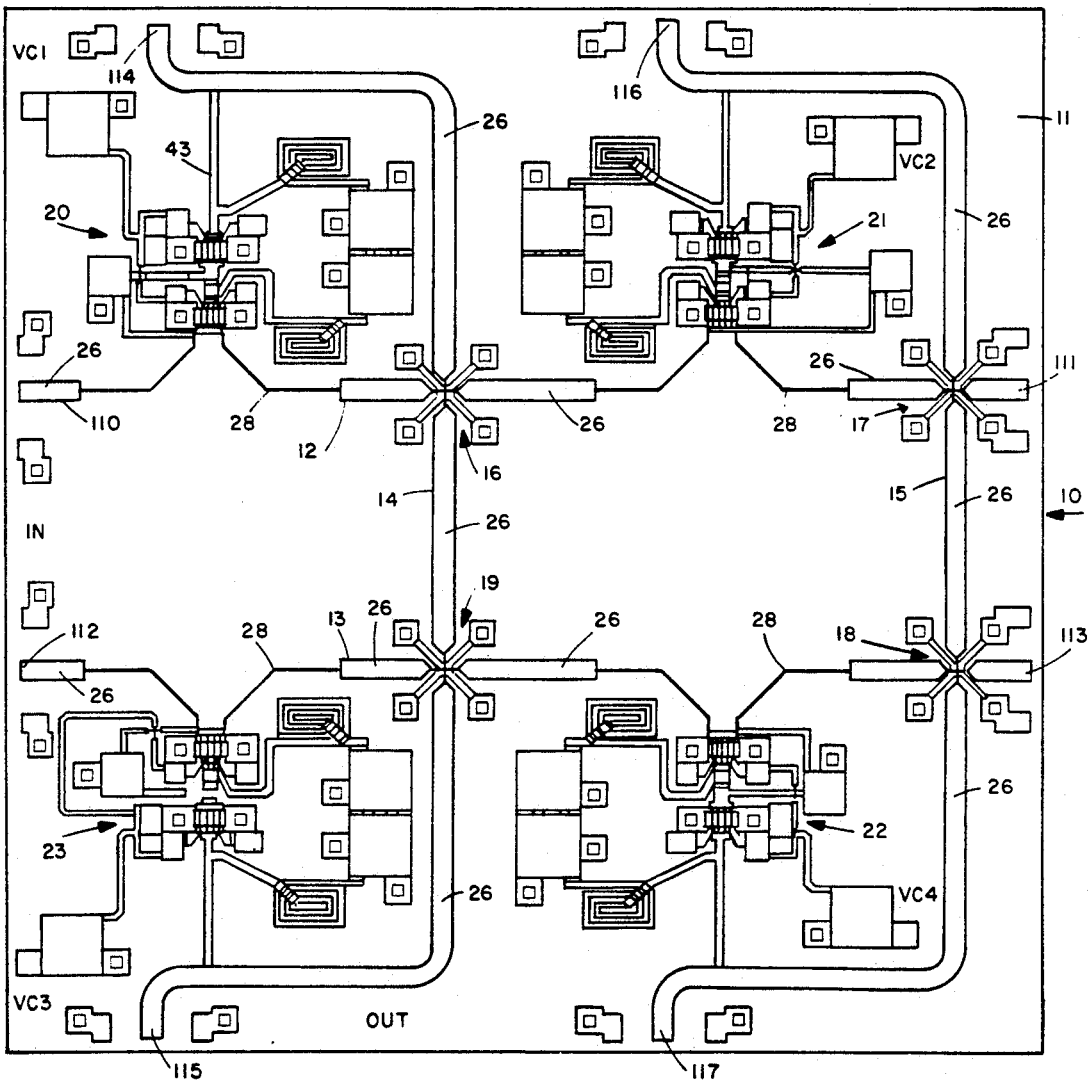
FIG. 1 is a mask diagram of a switch matrix constructed in accordance with one embodiment of the present invention.

FIG. 1 is a top view of a basic switch matrix module 10 constructed according to one embodiment of the present invention. Generally included on the surface of a substrate 11 are a pair of input transmission lines or conductors 12,13, a pair of output transmission lines or conductors 14,15, four crossovers 16-19 for the transmission lines, and four switches 20-23 for selectively connecting the transmission lines.

Transmission lines 12,13 run generally parallel to each other across substrate 11 and include regular transmission line portions 26, members of the crossovers 16-19 and inductive portions 28. In one embodiment, the regular transmission line portions 26 are standard fifty (50) ohm conductors.

Switches 20-23 include dual gate monolithic field effect transistors, FETs, and are individually controllable to enable selective connection of either or both of the input lines 12,13 to either or both of the output lines 14,15. The operation of switches 20-23 are better explained in reference to FIG. 2.

Figure 2:
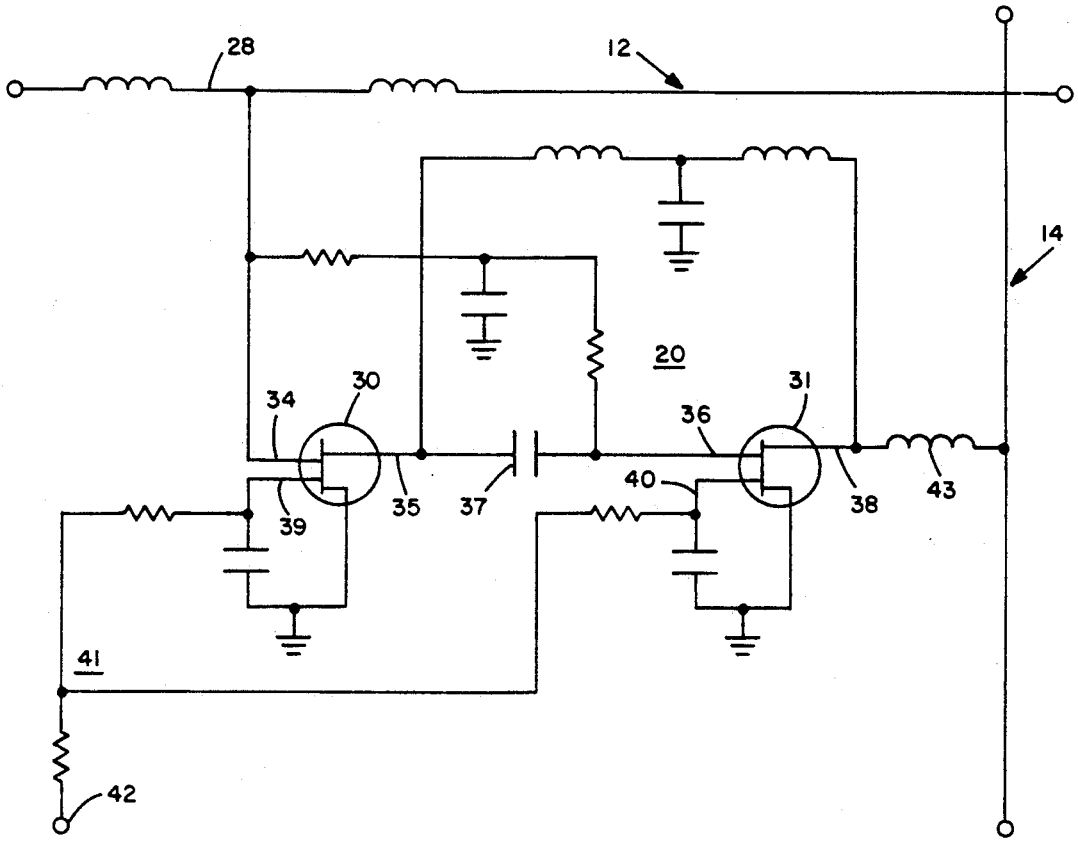
FIG. 2 is a circuit diagram of a portion of the circuit of FIG. 1.

FIG. 2 is a schematic diagram of an individual switch 20 used in the matrix embodiment of FIG. 1. Generally included are a pair of dual gate FETs 30,31 the first of which 30 is connected to use Cgs, the gate-source capacitance of the first gate, for the purpose of coupling the rf signal from the conductor 12. The FETs 30,31 serve to connect the input line to the output line with gain in the on state, and isolate the input and output lines in the off state. The FETs also provide isolation of the input line 12 from other signals on output line 14 during the on state. The use of two FETs in a serial coupling improves the isolation and gain of the switch 20. The rf signal is outputted from each FET through the drain terminal and under the control of the second gate terminal and signals connected thereto.

For these purposes, transmission line 12 is connected to the first gate terminal 34 of FET 30, drain terminal 35 of FET 30 is coupled to the first gate terminal 36 of FET 31 through a capacitor 37, and the drain terminal 38 of FET 31 is coupled to output transmission line 14. Control of FETs 30,31 is provided through the second gate terminal 39, 40, respectively for each FET by a resistor network 41 and a control terminal 42. The source terminal of each FET is grounded.

FIG. 2 also shows the inductive portion 28 of the transmission line 12. This inductive portion 28 is inserted into the transmission line to counteract the capacitive reactance of FET 30. The combination of the inductive portion 28 and the capacitance Cgs of the FET 30 creates a lumped equivalent transmission line in a manner similar to that used for the distributed amplifiers described in the article cited above in the Background. The inductive portions 28 are formed by constructing a narrow transmission line compared to the regular portions 26. Although this is done without an impedance taper as discussed below for the crossovers, the net impedance of these portions 28, lumped with the Cgs is the equivalent of the regular fifty ohm transmission line.

High impedance transmission line 43 is also used for coupling the drain terminal of FET 31 to transmission line 14. This prevents the capacitance of the FET drain from affecting the impedance of line 14 and is also simply formed as shown in FIG. 1 by a narrower strip of transmission line.

Figure 3:
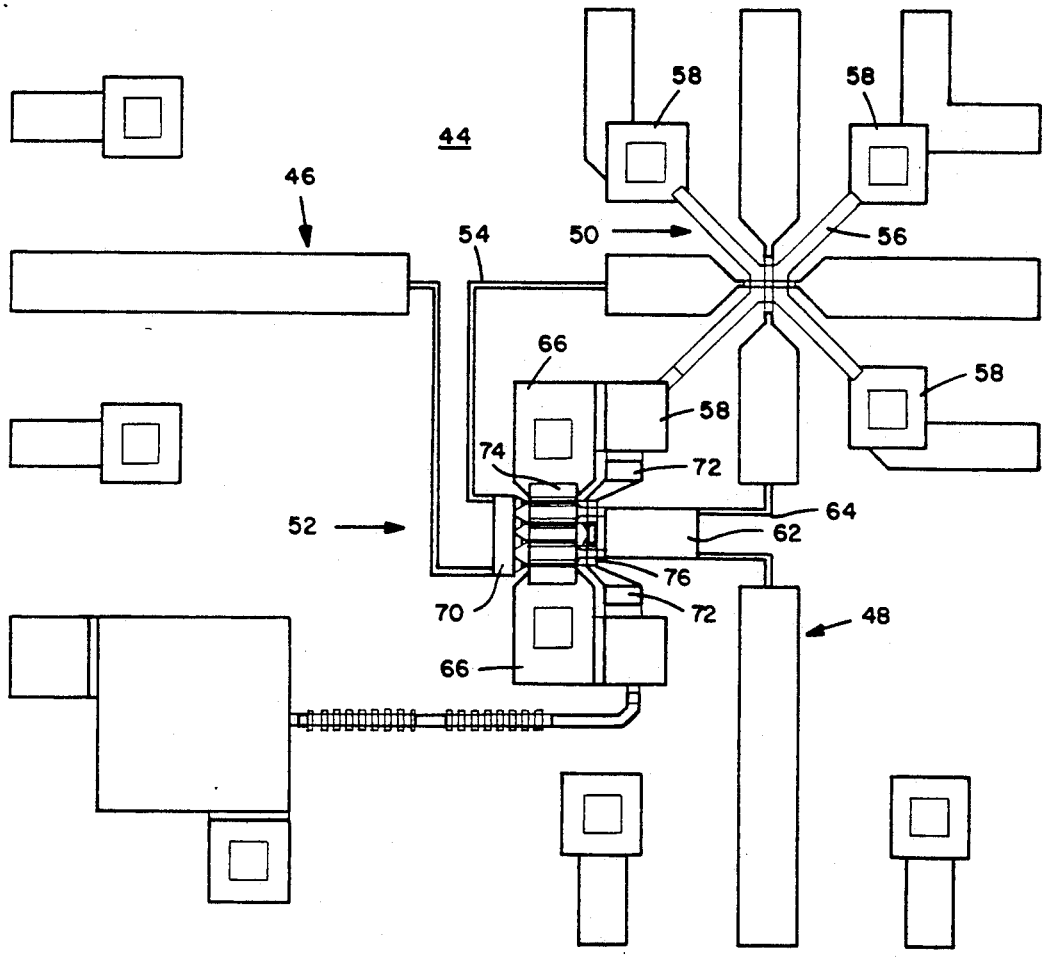
FIG. 3 is a mask diagram of a switch matrix element constructed in accordance with another embodiment of the present invention.

FIG. 3 is a mask diagram of a matrix element 44 constructed in accordance with another embodiment of the present invention. The element 44 includes an input line 46, an output line 48, a crossover 50 and a switch 52. Transmission line 46 is shown to include an inductive portion 54, and crossover 50 is shown to include a ground plane 56 which is connected to ground by four vias 58. These are plated holes passing through the substrate to a ground plane on the other side. The switch 52 is shown as a single FET with the drain pad 62 being connected to the output line 48 in the middle of an inductive portion 64.

The FET of switch 52 may be effected by any suitable device such as an interdigitated dual gate FET having its like terminals interconnected to form a single gate. Shown are source terminal pads 66, a common drain terminal pad 62, a common first gate terminal pad 70 and common second gate terminal pads 72. Source terminals 66 are shown to be interconnected by an airbridge 74, and second gate terminal pads are interconnected by an airbridge 76.

Figure 4:
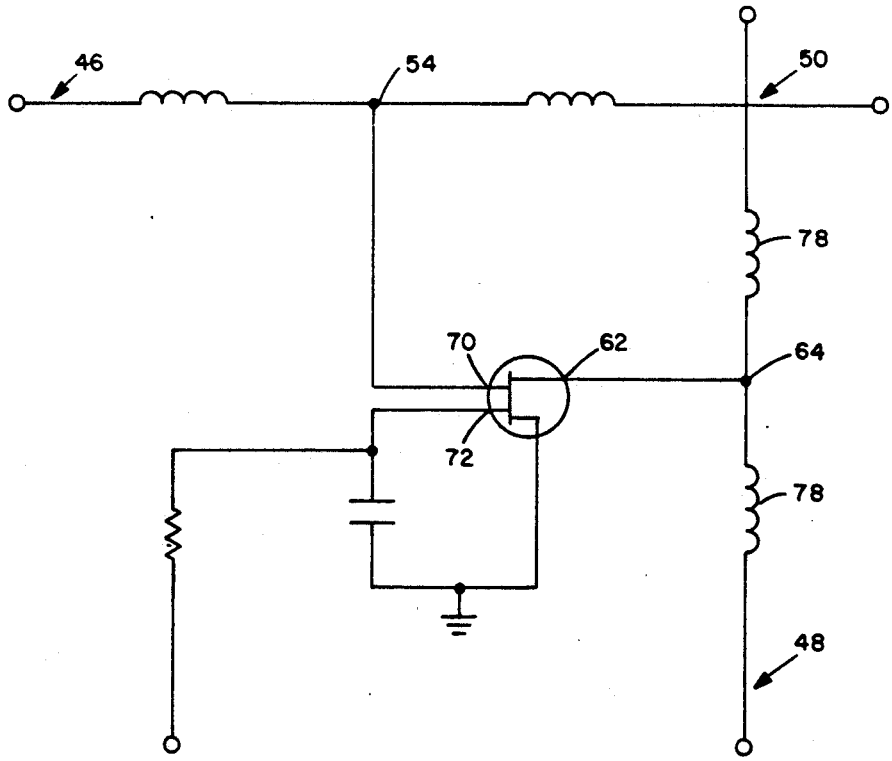
FIG. 4 is a circuit diagram of the element of FIG. 3.

FIG. 4 is a schematic diagram of the element of FIG. 3 with the corresponding components labeled accordingly. The crossover 50 is only shown representationally but is described in greater detail below. The inductive portion 64 is shown as a pair of inductor elements 78 which perform the same impedance matching function as the inductive portion 28 of FIGS. 1 and 2. This inductive portion 64 is effective for a wider bandwidth than high impedance element 43 of FIGS. 1 and 2.

Figure 5:
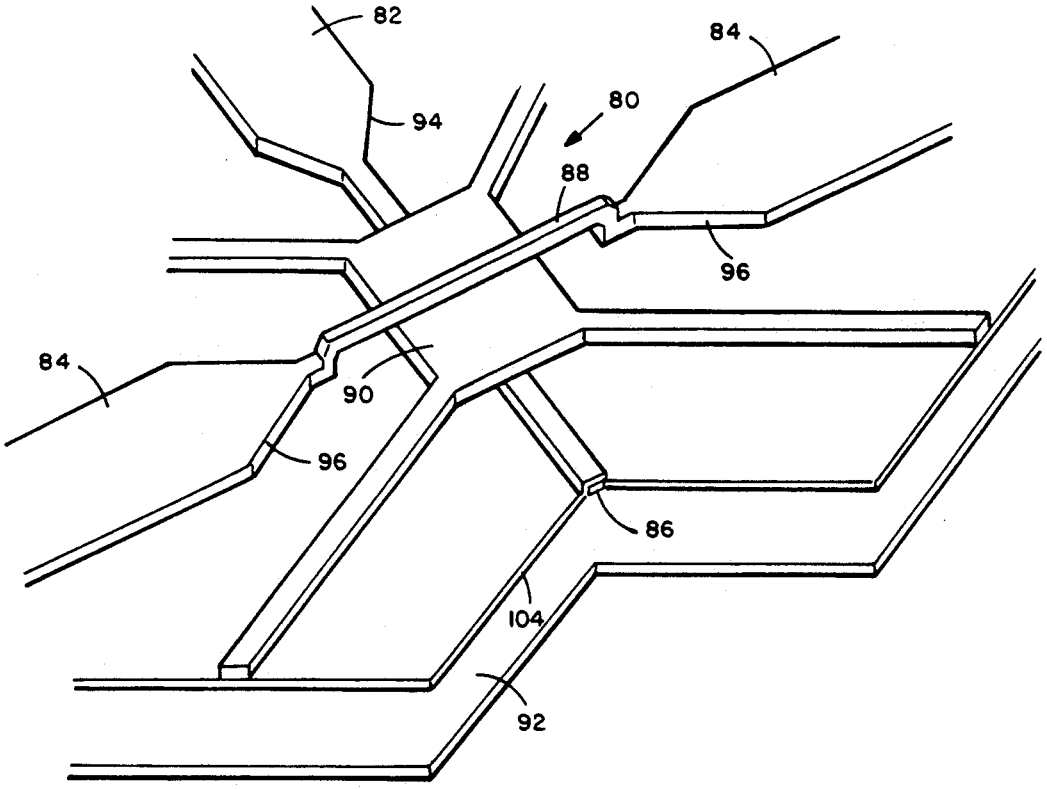
FIG. 5 is a perspective view of an airbridge crossover constructed in accordance with an embodiment of the present invention.

FIG. 5 is a perspective view of a crossover constructed in accordance with one embodiment of the present invention. The crossover 80 is used at the intersection of the transmission lines for the embodiments described herein. Shown are a pair of transmission lines 82,84, a lower crossover conductor 86, an airbridge 88 and a grounded shield 90.

The lower conductor 86 connects the two portions of transmission line 82 and is formed directly on a substrate 92. A dielectric or insulating layer 104 is then formed over conductor 86 to provide separation from the grounded shield 90. After formation of shield 90, the airbridge 88 is formed, separated from shield 90 by an air gap. Both of the conductors 82,84 include tapers 94,96 in their line widths for providing a smooth impedance transition to the respective crossover member. Of course the impedance of both lower conductor 86 and airbridge 88 is affected by the presence of grounded shield 90. The proximity of shield 90 reduces the impedance of both conductor 86 and airbridge 88. This dictates that the width of both be reduced for the purpose of raising the impedance closer to the standard fifty (50) ohms of the transmission lines.

An important aspect of this embodiment is the fully monolithic process which is used to construct the crossover in general and the airbridge in particular. The above mentioned U.S. Pat. No. 4,731,594 discloses a crossover which is formed by the bonding of an airbridge to the conductors. The patent discusses the problems of using bonding wires for the bridges because of inconsistencies between separate bridges. Unfortunately, as operating frequencies get higher and circuit dimensions get smaller, any bonding process will only meet with increasing difficulties and especially for circuit components handling high frequency signals. For this reason the present embodiment uses a fully monolithic, photo resist construction process for all high frequency components which eliminates the need for bonding operations.

Figure 6:
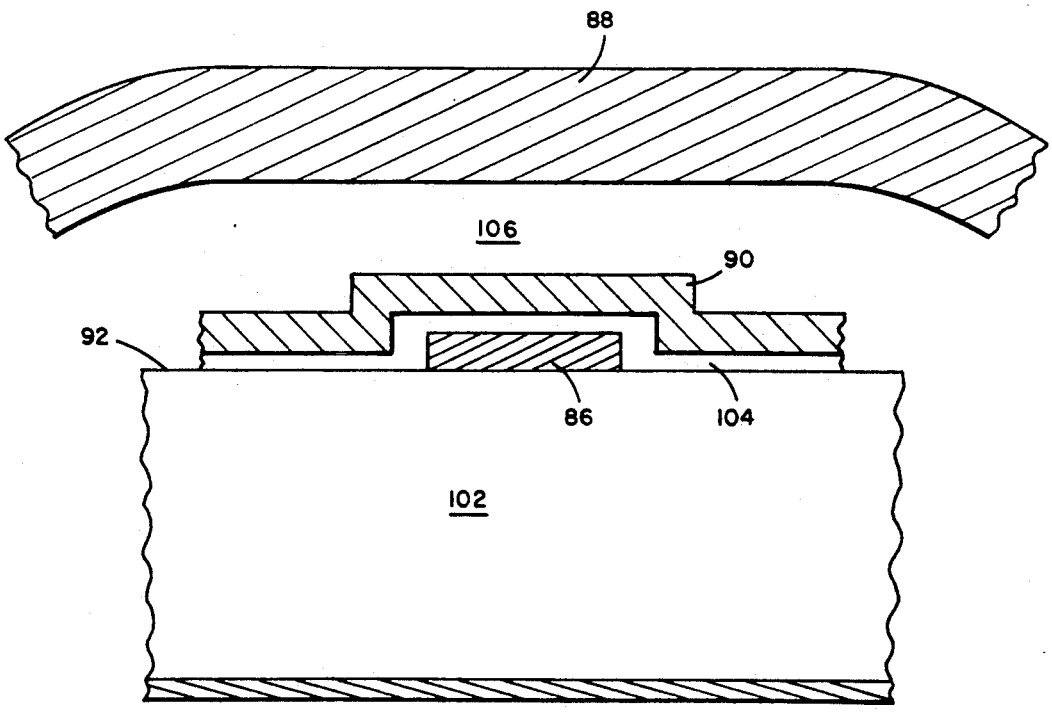
FIG. 6 is a sectional view of the airbridge of FIG. 5 taken along view lines 6—6.

The basic principals of the monolithic construction process used for the present embodiments are well known as evidenced by the above mentioned article which is hereby incorporated by reference, herein. The specific steps used in forming the airbridge 88 and shield 90 are described in reference to FIG. 6 which is a sectional view of the crossover 80 of FIG. 5 taken along view lines 6—6. These process steps follow.

1. The first transmission line 86 is formed on the GaAs substrate 102, along with transmission lines 82,84 and ground pads for shield 90, using standard monolithic construction processes.

2. A of silicon nitrate, $Si_3N_4$, dielectric layer 104 is applied over the transmission line 86 and substrate 92 and openings are formed through it to transmission line 84 and the ground pads for shield 90.

3. A layer of photoresist is then patterned to locate the shield 90.

4. A layer of gold is deposited over the dielectric. This layer of gold forms the isolating ground plane.

5. Unwanted metal is then lifted off using a suitable solvent thus forming the shield 90.

6. A layer of photoresist 106 is deposited on top of the gold layer and contacts to transmission line 84 are formed by exposing and developing the photoresist 106. This photoresist will separate the airbridge 88 from the shield 90.

7. An interconnect layer of gold is deposited on top of the photoresist 106.

8. Another layer of photoresist is deposited on top of the gold.

9. The airbridge 88 is photonically exposed and developed as a pattern on the uppermost photoresist layer.

10. The airbridge pattern is then electroplated to form the actual airbridge 88.

11. A solvent is applied which removes the uppermost photoresist layer exposing the interconnect layer of gold of step 7.

12. The interconnect layer of gold is etched away exposing the lower layer of photoresist material.

13. A solvent or rinse is applied to remove the lower layer 106 thus forming the airbridge separation between the airbridge and the shield 90.

14. A standard via process is used to connect the ground pads of shield 90 through the substrate 102 to the ground plane.

The above monolithic construction process and the matrix arrangement shown in FIG. 1 enable the present invention to be used to construct matrices having different numbers of input and output lines by simply repeating the mask patterns used for FIG. 1. In this manner, portions 110,111 of conductor 12, portions 112,113 of conductor 13, portions 114,115 of conductor 14 and portions 116,117 of conductor 15 are interconnected from one repetition of the mask pattern to the next. The use of a lumped equivalent transmission line helps to maintain the level of any signal in the transmission line for distribution to additional matrix modules either without, or with only limited use of intermediate buffer amplifiers to raise signal levels. This reduction or simplification enables higher functional density for the monolithic circuit. It is estimated that five of the matrix modules of FIG. 1 may be cascaded without the need for a buffer amplifier.

CONCLUSION

As described for the above embodiments, the present and low loss transmission lines enable the matrix to be easily configured for different instrumentation including different frequency ranges.

The embodiments described above are intended to be taken in an illustrative and not a limiting sense. Various modifications and changes may be made to the above embodiments by persons skilled in the art without departing from the scope of the present invention as defined in the appended claims.

What is claimed is:

1. A monolithic microwave transmission line crossover, comprising:

a monolithic integrated circuit substrate;

a lower conductor formed on a surface of the substrate;

a dielectric spacer formed on top of the lower conductor;

a grounded conductor formed on top of the spacer; and an upper conductor formed as an airbridge over and electrically separated from eh grounded conductor, said airbridge having an integrated circuit construction.

* * * * *